US005639043A

United States Patent [19]

Baird

[11] Patent Number: 5,639,043

[45] Date of Patent: Jun. 17, 1997

[54] DESPOOLED FILAMENT TENSION CONTROL DEVICE

[76] Inventor: Terry Alexander Baird, 11158 NW. Kathleen Dr., Portland, Oreg. 97229

[21] Appl. No.: 549,466

[22] Filed: Oct. 27, 1995

[51] Int. Cl.[6] ..... B65H 59/04; B65H 59/06

[52] U.S. Cl. ..... 242/419.4; 242/422.6; 242/125.3; 242/129.8; 242/149

[58] Field of Search ..... 242/419.4, 422.5, 242/422.6, 405, 405.3, 557, 539, 546.1, 129.8, 149, 156.1, 156, 601, 125.3, 386, 171, 172; 206/400, 53

[56] References Cited

U.S. PATENT DOCUMENTS

| | | | |
|---|---|---|---|
| 379,887 | 3/1888 | Crannell . | |
| 693,854 | 2/1902 | Gamble | 242/125.3 |
| 954,562 | 4/1910 | Cone | 242/172 |
| 1,222,703 | 4/1917 | White | 2452/125.3 |
| 1,387,299 | 8/1921 | Oliver | 242/125.3 |
| 1,991,263 | 2/1935 | Stewart | 242/419.4 |
| 2,696,952 | 12/1954 | Beier | 242/130 |
| 2,716,008 | 8/1955 | Taylor | 242/171 |
| 2,869,802 | 1/1959 | Williams | 242/156.1 |
| 2,909,913 | 10/1959 | Strug, Jr. et al. | 66/125 |
| 3,218,003 | 11/1965 | Bradshaw | 247/129.8 |
| 3,249,320 | 5/1966 | Frederick | 242/137.1 |
| 3,307,805 | 3/1967 | Verbeek | 242/129.8 |
| 3,596,847 | 8/1971 | Petersen . | |
| 3,614,067 | 10/1971 | Vermette . | |
| 3,687,386 | 8/1972 | Sandbach | 242/419.4 |
| 3,888,010 | 6/1975 | Hyde et al. | 242/405 |
| 3,918,652 | 11/1975 | Bassett | 242/46.4 |
| 3,938,753 | 2/1976 | Oshima . | |
| 3,941,327 | 3/1976 | McCollum et al. . | |
| 3,976,261 | 8/1976 | Lang | 242/128 |
| 4,050,020 | 9/1977 | Knox . | |
| 4,171,110 | 10/1979 | Hawn . | |
| 5,211,349 | 5/1993 | Sinar . | |
| 5,246,185 | 9/1993 | Vincent | 242/172 |

FOREIGN PATENT DOCUMENTS

| | | | |
|---|---|---|---|
| 52943 | 4/1937 | Denmark | 242/129.8 |
| 6233 | of 1898 | United Kingdom | 242/125.3 |

*Primary Examiner*—John M. Jillions
*Attorney, Agent, or Firm*—Marger, Johnson, McCollom & Stolowitz P.C.

[57] ABSTRACT

The invention is a filament tensioning device for use on a spool of a type having filament coiled around a cylindrical barrel bounded by flanges at each end of the barrel. The device, constructed in accordance with the present invention, includes a belt or strip of elastic material such as neoprene. The elastic strip is formed into a ring and end portions adjacent the long ends of the strip are bent transverse to the outer surface of the ring forming a radially extending tab. The two end portions are attached and preferably stitched together using two seams, thereby forming a passage therebetween which extends from the strip ends through the length of the tab into the interior of the ring.

In use, the filament tensioning device is placed over the barrel of the spool between the flanges and elastically contracts about and circumscribes the coiled filament. The leading edge of the filament is passed through the passage within the tab and out through the top thus separating and distinguishing the leading edge from the remaining spooled filament. The inner surfaces of the passage are in such close approximation that opposing outer surfaces of the filament are frictionally engaged and resistive to unspooling. In one preferred embodiment, the inner surface of the passage may be coated with a film such that filament passed through the passage will contact and be coated by the film.

16 Claims, 1 Drawing Sheet

FIG. 1
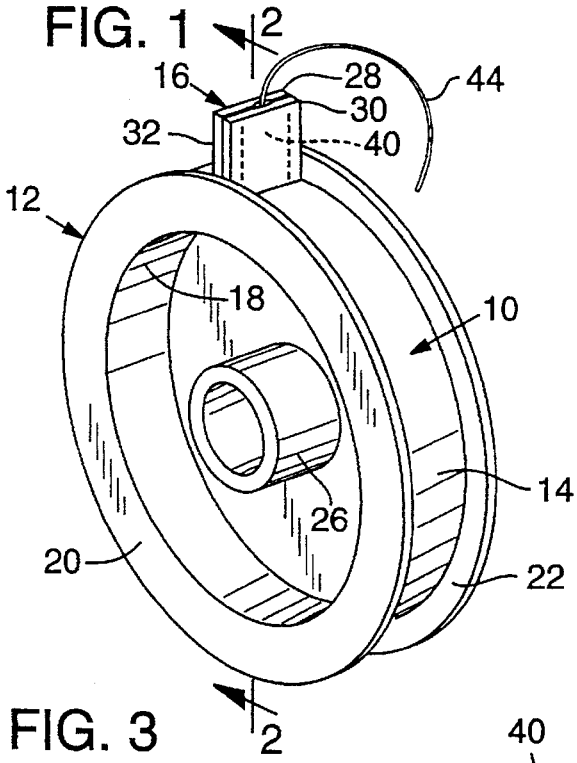
FIG. 2
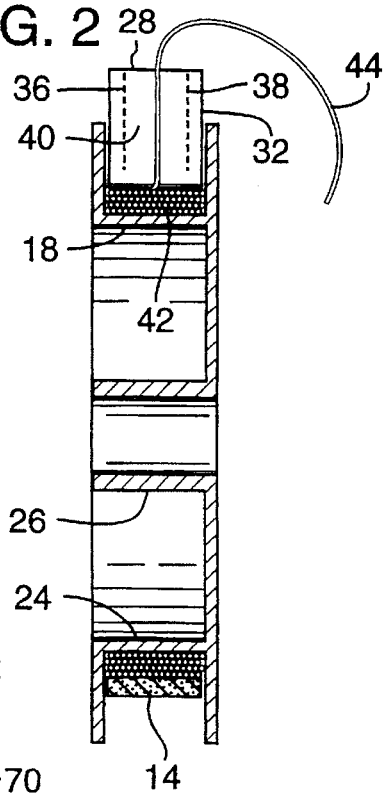
FIG. 3
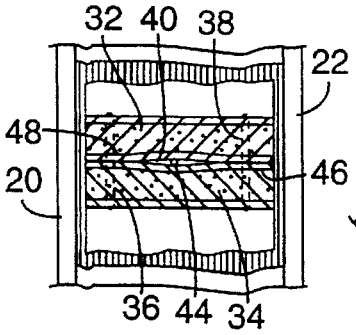
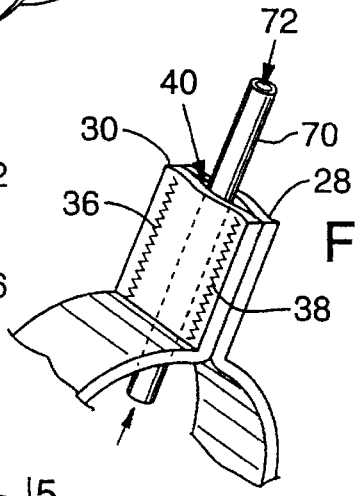
FIG. 6
FIG. 5
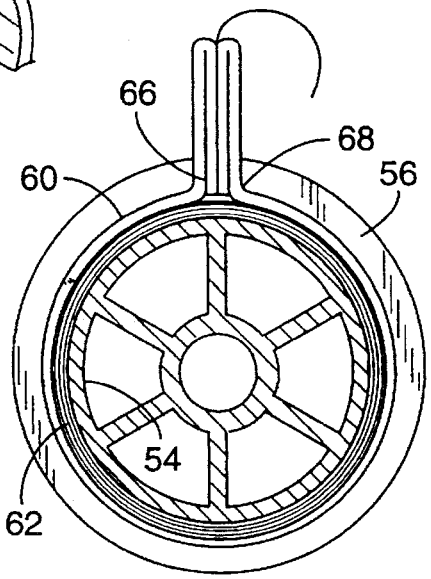
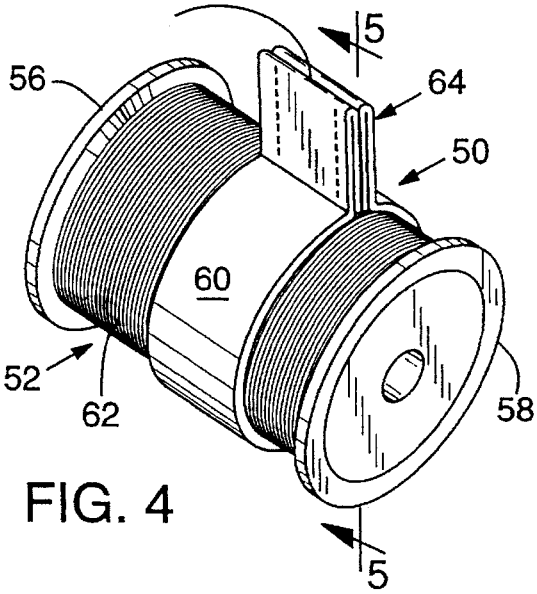
FIG. 4

DESPOOLED FILAMENT TENSION CONTROL DEVICE

BACKGROUND OF THE INVENTION

This invention relates generally to a tension control apparatus and more particularly to an apparatus which controls the tension on an elongate filament to prevent unwanted inertial unravelling as the filament is unwound from a spool.

Spooled material having either rigid or elastic properties such as fishing line or non-elastic lines, ropes, filaments, and particularly sewing thread, has a tendency for inertial unraveling when dispensed thus causing a certain free play and looseness. This is undesired in many applications and can lead to uneven stitching when sewing, tangled lines when fishing, and miswound cable in nautical and industrial applications. Additionally, untensioned lines make it more difficult to find the terminal end of the line.

This is particularly important in fly tying where controlled amounts of filament must be dispensed. When a desired amount has been dispensed, the filament is cut and another segment of filament made available for another portion of the fly. When cut, the tension on the filament is released and the terminal end curls about the spool, often making it difficult to find again. Using one's fingers to find the end of the tiny and nearly invisible filament is tedious and often frustrating work.

Most tensioning devices apply torque to the axle or spindle upon which the spool is mounted, thus allowing the filament to be played out as long as a threshold tension is continuously applied to the terminal end of the filament. Unfortunately, these spindle tensioning devices do not make it easier to find the leading edge of the filament.

Accordingly, a need remains for an inexpensive tensioning device which is fittable on a variety of spool sizes and filament types and which presents the leading edge of the filament.

SUMMARY OF THE INVENTION

It is, therefore, an object of the invention to apply equal tensioning to spooled material having either a flat or circular cross section.

Another object of the invention is to accommodate spools of various diameters.

A further object of the invention is to separate and distinguish the leading end of the spooled material from its body.

The invention is a filament tensioning device for use on a spool of a type having filament coiled around a cylindrical barrel bounded by flanges at each end of the barrel. The device, constructed in accordance with the present invention, includes a belt or strip of elastic material such as neoprene. The elastic strip is formed into a ring and end portions adjacent the long ends of the strip are bent transverse to the outer surface of the ring forming a radially extending tab. The two end portions are attached and preferably stitched together using two seams, thereby forming a passage therebetween which extends from the strip ends through the length of the tab into the interior of the ring.

In use, the filament tensioning device is placed around the barrel of the spool between the flanges and elastically contracts about and circumscribes the coiled filament. The leading edge of the filament is passed through the passage within the tab and out through the top thus separating and distinguishing the leading edge from the remaining spooled filament. The inner surfaces of the passage are in such close approximation that opposing outer surfaces of the filament are frictionally engaged and resistive to unspooling. In one preferred embodiment, the inner surface of the passage may be coated with a film such that filament passed through the passage will contact and be coated by the film. This film can further be used to retard or create friction or dispense lubrications to lines, filaments, wires, cables and other spooled material.

During unspooling of the filament from the spool, the spool may be mounted on a freely spinning axle. A user is directed to the leading edge of the filament by finding the tab portion of the invention extending radially from the spool barrel. As the leading edge is pulled outward from the spool, the tensioning device remains in place as the spool rotates under it. The inner surface of the circular belt portion of the device in elastic contraction about the spooled filament frictionally engages the spool to create a resistive force to the rotational momentum of the spool. Tension can be increased by tightening the elastic fit of the device about the barrel. Additional resistive force is created by the frictional engagement of the passage with the received unspooling filament. When the despooling forces on the leading edge of the filament drop below a certain threshold, the inner surface of the circular belt portion grips the spooled filament causing the tensioning device and spool to rotate together, thus preventing further unspooling of the filament from the spool.

The present invention offers several advantages. First, the elastic nature of the device allows it to be used on variously sized spools and under various tensions. Second, the use of lightweight elastic materials such as neoprene allow the spool and mounted device to float in water, thus making it ideal for use with fishing line. Third, the dispensing tab of the device enables one to more easily locate the leading edge of the filament in the dark or in situations where your eyes must be looking elsewhere.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 1 is a perspective view of the preferred tensioned spool dispenser constructed according to the present invention.

FIG. 2 is a sectional view of the spool dispenser of FIG. 1 taken along line 2—2.

FIG. 3 is a partial top view of the spool dispenser of FIG. 1 showing the dispensed filament received within a passage of the tab.

FIG. 4 is a perspective view showing an alternate embodiment of the invention.

FIG. 5 is a sectional view of the invention shown in FIG. 4 taken along line 5—5.

FIG. 6 is a perspective view of an alternate tab portion for the spool dispenser of FIG. 1.

DETAILED DESCRIPTION

FIGS. 1 and 2 shows the preferred embodiment of the spool tensioning device at 10 in operative position about a spool 12. Device 10 includes an elastic circular belt 14 and a tab 16 which extends radially away from the surface of the belt. Spool 12 includes a cylindrical barrel 18 bounded by flanges 20, 22 located adjacent each end of the barrel 18 thereby defining a space for a filament coil 24, shown best in FIG. 2. Spool 12 further includes a centrally located bore 26 enabling the spool to be mounted on an axle (not shown) for free rotation.

The spool 12 shown in FIG. 1 is similar to those used to contain fishing line such as for fly fishing and can be made from materials such as injection molded plastics or stamped metal.

In its preferred embodiment, device 10 is made from a single strip of elastic material terminating in first and second ends 28, 30 located at either long ends of the strip. Neoprene material is desired for fishing spools because of its buoyant properties, thus allowing spool 12 and device 10 to float. Other materials considered suitable are flat rubber, flat elastic (both woven and braided), polyurethane, elastic, lycra nylon, binding tape, tubular latex, lycra webbing or rubber tubing, woven braided tubing, and stretch gauze taping or webbing.

Tab 16 is formed by folding first and second end portions 32, 34 transverse to the surface of belt 14 and adjacent to one another so that they extend above flanges 20, 22. End portions 32, 34 are bonded together, as along stitched seams 36, 38, along a substantial length of the tab 16 to thereby form a passage 40 therebetween. Alternate bonding means of end portions 32, 34 within the fastening arts can be envisioned, such as by gluing or heat bonding, which are also capable of forming a passage 40 between portions 32, 34. One means for allowing adjustment and removal of device 10 is by providing hook and loop fastener material to opposing inner surfaces 46, 48 of the tab 16, thereby allowing the belt 14 to be snuggly fitted about barrel 18.

Passage 40 runs from ends 28, 30 down through tab 16 and out through an opening in belt 14, shown at 42, to the barrel 18 of spool 12 where the filament 24 is coiled. In this way, a leading edge 44 of filament 24 may pass through tab 16, received within passage 40, and out through the top of the tab 16 where it is exposed for gripping by a user.

As shown best in FIGS. 2 and 3, belt or strip 14 may have a width substantially equal to the width between flanges 20, 22 to fit snugly therebetween. In alternate embodiments of the invention, as shown in FIGS. and 5 where the width of the barrel is wide compared to its diameter, a narrower strip may be preferred. The relaxed diameter of the belt 14 of device 10 should be less than the diameter of the spool barrel 18 to effect frictional forces circumferentially about the coiled filament 24. The tension on filament 24 may be adjusted by regulating the elasticity of the material used for device 10, the relaxed diameter of the belt 14, and the roughness of the inner surface of the belt 14 contacting the coiled filament 24.

FIG. 3 shows the leading edge 44 of filament 24 received within passage 40. End portions 32, 34 are stitched together along parallel seams 36, 38 forming passage 40 therebetween. The seams 36, 38 can alternately be envisioned as slanting toward one another thereby forming a narrowing funnel portion adjacent the first and second ends of the strip. As the leading edge 44 of the filament is received through passage 40, the inner surfaces 46, 48 of end portions 32, 34 resiliently deforms to admit the leading edge 44. The elastic nature of inner surfaces 46, 48 cause them engage against opposing outer surfaces of the leading edge 44, thereby frictionally engaging the leading edge 44 within passage 40.

Inner surfaces 46, 48 may alternately be coated with a film of material so that when the filament is received within the passage 40, the film is frictionally transferred to the filament, thus coating it as it is dispensed. It is understood that an insert containing the material to be transferred, such as a rosin sack or medicinally soaked gauze, can also be placed within passage 40 between inner surfaces 46, 48 to enable a similar result. A useful application for this may be in the medical field where monofilament sutures can be coated with an antiseptic or other substance as they are dispensed from a spool of the monofilament.

FIG. 4 shows an alternate embodiment of the tensioned spool device at 50 constructed according to the invention. Device 50 is engaged with spool 52 of a type commonly used in sewing applications, including a barrel 54 bounded by flanges 56, 58. Belt 60 of device 50 has a width narrower than the barrel to allow its inner surface to slide from side to side along the length of the barrel as the coiled filament 62 is dispensed from the spool 52.

Tab 64 is constructed in a similar fashion as described above except that terminal ends 66, 68 of the strip 60 are folded upward and inward as shown best in FIG. 5. In this fashion, strip terminal ends 66, 68 are adjacent a proximal end of the passage near the coiled filament 62 and the upper ends of the tab 64 are prevented from fraying.

When the spool 12 and tensioning device 10 are used in combination, as when dispensing a measured amount of filament, spool 12 is allowed to turn relative to belt 14 placed about the barrel 18 as the terminal edge 44 of the filament is pulled outward through tab 16. The pulling forces imparted to the filament create rotational forces as the filament is despooled, thus causing spool 12 to turn. The elastic belt 14 of device 10, in frictional contact with the coiled filament 24 about the circumference of the barrel 18, initially prevents the spool 12 from turning. When the pulling forces are greater than the frictional forces, however, the spool 12 begins turning beneath the belt 14. When the pulling forces are reduced to below the frictional forces imparted by belt 14 to the spool 12, the rotation of the spool is stopped and the filament is prevented from unraveling. Thus, tension is kept at all times on the dispensed filament depending upon the elastic and dimensional characteristics of the tensioning device 10 as more fully described above.

Rewinding the filament about the barrel 18 of the spool 12 can be accomplished by rotating the spool relative to the belt 14 in the opposite direction as above. Thus, an operator can, for instance, grip the tab portion 16 and rotate the tab portion about the barrel 18. As the filament winds onto the barrel, the exposed portion of the filament adjacent the leading edge 44 is pulled through the passage 40. Thus, only the easily grasped tab and not the filament need be gripped in order to wind the filament back on the spool.

FIG. 6 shows the addition of a tubular straw 70 passing through passage 40 of tab 16 whereby the outer surface of straw 70 is frictionally engaged by the inner surface of the passage 40. The straw 70 includes a bore 72 passing through the length of the straw having a diameter slightly more than the diameter of the filament received within the bore. The straw 70 extends above the first and second ends 28, 30 to present the leading edge 44 of the filament 24, thus creating a fly tier's bobbin. As is evident from the FIG. 6, straw 70 may be tilted within passage 40 to present the leading edge of the filament at a variety of angles. It is also understood that the tubular straw 70 can be bent at an angle to accomplish the same purpose.

Having described and illustrated the principles of the invention in a preferred embodiment thereof, it should be apparent that the invention can be modified in arrangement and detail without departing from such principles. I claim all modifications and variation coming within the spirit and scope of the following claims:

1. A filament tensioning device for use on a spool of a type having filament coiled around a cylindrical barrel and bounded by flanges located adjacent each end of the barrel, the device comprising:

a circular elastic belt;

an opening defined in the belt;

a tab extending radially away from the circular elastic belt, said tab having an elongate interior passage running a substantial length of the tab, said passage being positioned over the opening and having an elastically pinched inner surface to thereby contact and frictionally engage a filament received through the passage.

2. The device of claim 1, wherein the elastic belt and the dispenser are made from the same material.

3. The device of claim 2, wherein the elastic belt and the dispenser are made from neoprene.

4. The device of claim 1, wherein the inner surface of the passage includes a film, said film being transferable to the filament when the filament is received through the passage.

5. The device of claim 4, wherein the film is an antiseptic substance.

6. The device of claim 1, further including an elongate straw having a tubular bore defined therethrough, said straw being received within the elongate interior passage and extending above a distal end of the tab, said tubular bore being capable of receiving the filament therewithin for presenting a leading edge of the filament from a distal end of the straw.

7. A filament tensioning device for use on a spool of a type having filament coiled around a cylindrical barrel and bounded by flanges located adjacent each end of the barrel, said device comprising:

an elastic strip terminating in first and second ends, said strip sized to circumvent a barrel of a spool, said strip having first and second end portions adjacent said first and second ends, said first and second end portions being bent transverse to the surface of the strip and attached to each other along left and right bond lines running a substantial length of the portions, thereby defining a passage between the left and right bond lines through which a filament is receivable.

8. The device of claim 7, wherein the transversely bent end portions are folded inward so that the first and second terminal ends of the elastic strip are adjacent a proximal end of the passage.

9. The device of claim 7, wherein the elastic strip is made from neoprene.

10. The device of claim 7, wherein the first and second end portions are stitched together.

11. The device of claim 7, further including a film within the passage, said film being transferable to a filament when such a filament is received through the passage.

12. The device of claim 11, wherein the film is an antiseptic substance.

13. The device of claim 7, wherein the left and right bond lines slant toward one another thereby forming a narrowing funnel portion adjacent the first and second ends of the strip.

14. A tensioned dispensing spool comprising:

a cylindrical barrel containing a coil of filament;

a flange located at each end of the barrel defining a space for said filament; and an elastic belt placed about the barrel between the flanges, said belt engaging substantially around the coil and having an inner surface which lies against the coil and including an opening through which is received a leading end of the coil, said belt including a dispensing tab portion having a elongate passage in communication with the opening and extending radially away from the cylindrical barrel, said passage having an inner surface which is frictionally engageable with the received filament, wherein the tab portion further includes:

first and second end portions having opposingly faced inner surfaces in contact with one another, said end portions being bonded together at two locations along the opposingly faced inner surfaces, thereby defining said passage therebetween.

15. A method for tensioned dispensing of a filament from a spool of a type having filament coiled around a cylindrical barrel and bounded by flanges located adjacent each end of the barrel, the method comprising:

enclosing an elastic belt having a radially depending passage, defined therethrough about a portion of the barrel above the coiled filament;

frictionally engaging a single surface of the enclosed filament coiled on the spool along the circumference of the barrel;

passing the leading end of the coiled filament through the radially depending passage of the belt;

frictionally engaging opposing surfaces of the filament within the passage adjacent the leading end.

16. The method of claim 15, wherein the passage includes inner surfaces engaged with the filament, the method further including:

coating the inner surfaces with a film; and distributing the film onto the filament as the filament is passed through the passage.

* * * * *